US011094230B2

(12) United States Patent
Tenthorey et al.

(10) Patent No.: US 11,094,230 B2
(45) Date of Patent: Aug. 17, 2021

(54) SPLIT FLAP DISPLAY

(71) Applicant: Oat Foundry LLC, Philadelphia, PA (US)

(72) Inventors: Luc Tenthorey, Philadelphia, PA (US); James Michael Vescio, Jr., Philadelphia, PA (US); John Halko, IV, Philadelphia, PA (US); Sean Patrick Rossiter, Philadelphia, PA (US); Michael Xavier Courtney, Philadelphia, PA (US)

(73) Assignee: Oat Foundry LLC, Philadelphia, PA (US)

( * ) Notice: Subject to any disclaimer, the term of this patent is extended or adjusted under 35 U.S.C. 154(b) by 0 days.

(21) Appl. No.: 16/856,745

(22) PCT Filed: Oct. 25, 2018

(86) PCT No.: PCT/US2018/057427
§ 371 (c)(1),
(2) Date: Apr. 23, 2020

(87) PCT Pub. No.: WO2019/084218
PCT Pub. Date: May 2, 2019

(65) Prior Publication Data

US 2020/0327831 A1 Oct. 15, 2020

Related U.S. Application Data

(60) Provisional application No. 62/577,441, filed on Oct. 26, 2017.

(51) Int. Cl.
*G09F 11/06* (2006.01)
*G09F 11/10* (2006.01)

(52) U.S. Cl.
CPC ..... *G09F 11/06* (2013.01); *G09F 11/10* (2013.01)

(58) Field of Classification Search
CPC ..... G09F 11/06; G09F 11/10
See application file for complete search history.

(56) References Cited

U.S. PATENT DOCUMENTS 686,965 A * 11/1901 Breton ..... G09F 11/06 40/475
834,319 A * 10/1906 Peritz ..... G09F 11/06 40/500

(Continued)

OTHER PUBLICATIONS

PCT/US2018/057427 International Preliminary Report on Patentability. dated Apr. 28, 202. 7 pages.

(Continued)

*Primary Examiner* — Gary C Hoge
(74) *Attorney, Agent, or Firm* — Joseph E. Maenner; Maenner & Associates, LLC

(57) ABSTRACT

A split flap display is provided. The display includes a wall frame mounted on a wall. The wall frame includes a plurality of panel guides extending outwardly therefrom, a breakout board mounted thereon, and a plurality of cantilevered snap locks extending outwardly therefrom. An array of carousel modules is mounted in a cabinet. The array includes a single row and a plurality of columns. The cabinet includes a locking slot adapted to releasably receive a free end of one of the plurality of cantilevered snap locks and a slide lock configured for longitudinal translation engagement with the free end of one of the plurality of cantilevered snap locks, such that translation of the slide lock displaces the free end of the cantilevered snap lock out of engagement with the locking slot. When the free end of the cantilevered snap lock is out of engagement with the locking slot, the array can be removed from the wall frame.

13 Claims, 13 Drawing Sheets

(56) References Cited

U.S. PATENT DOCUMENTS

| | | | | |
|---|---|---|---|---|
| 1,214,732 | A * | 2/1917 | Hopkins et al. | G09F 11/06 40/500 |
| 4,722,527 | A | 2/1988 | Gauselmann | |
| 5,477,630 | A * | 12/1995 | Tornow | G09F 11/06 40/475 |
| 2017/0055363 | A1 | 2/2017 | Ankarbjork et al. | |
| 2021/0005116 | A1 * | 1/2021 | Servaites | G09F 11/06 |

OTHER PUBLICATIONS

PCT/US2018/057427 International Search Report and Written Opinion. dated Feb. 17, 2019. 4 pages.
YouTube video. https://www.youtube.com/watch?v=vUJckrxeThA. Jan. 39, 2017. Not admitted as prior art.

* cited by examiner

SPLIT FLAP DISPLAY

CROSS-REFERENCE TO RELATED APPLICATION

The present application claims the benefit of U.S. Provisional Patent Application Ser. No. 62/577,441, filed on Oct. 26, 2017, which is incorporated herein by reference in its entirety.

BACKGROUND OF THE INVENTION

Field of the Invention

The present invention relates to electro-mechanical flip chart display boards.

Description of the Related Art

Split flap displays were well known devices used in train and bus stations to update departure and arrival times of trains and busses. Each letter on the board is comprised of a rotating wheel with a plurality of flaps that roll over as the wheel rotates. The wheel stops at a desired position, displaying the desired letter. This process repeats for all of the letters on the board. However, when the rotating mechanism for one of the letters malfunctions, the process to repair the mechanism is quite tedious, requiring the display to be disassembled to repair or replace the malfunctioning mechanism.

It would be beneficial to provide an improved split flap display that allows the repair or replacement of a single module without having to disassemble a large portion of the display.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a split flap display that includes a wall frame mounted on a wall. The wall frame includes a plurality of panel guides extending outwardly therefrom, a breakout board mounted thereon, and a plurality of cantilevered snap locks extending outwardly therefrom. An array of carousel modules is mounted in a cabinet. The array includes a single row and a plurality of columns. The cabinet includes a locking slot adapted to releasably receive a free end of one of the plurality of cantilevered snap locks and a slide lock configured for longitudinal translation engagement with the free end of one of the plurality of cantilevered snap locks, such that translation of the slide lock displaces the free end of the cantilevered snap lock out of engagement with the locking slot. When the free end of the cantilevered snap lock is out of engagement with the locking slot, the array can be removed from the wall frame.

In another embodiment, a split flap display includes a cabinet and a plurality of modules located in the cabinet in a first array. Each of the plurality of modules comprises a plurality of motor driven carousels. Each of the carousels includes a plurality of flaps.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
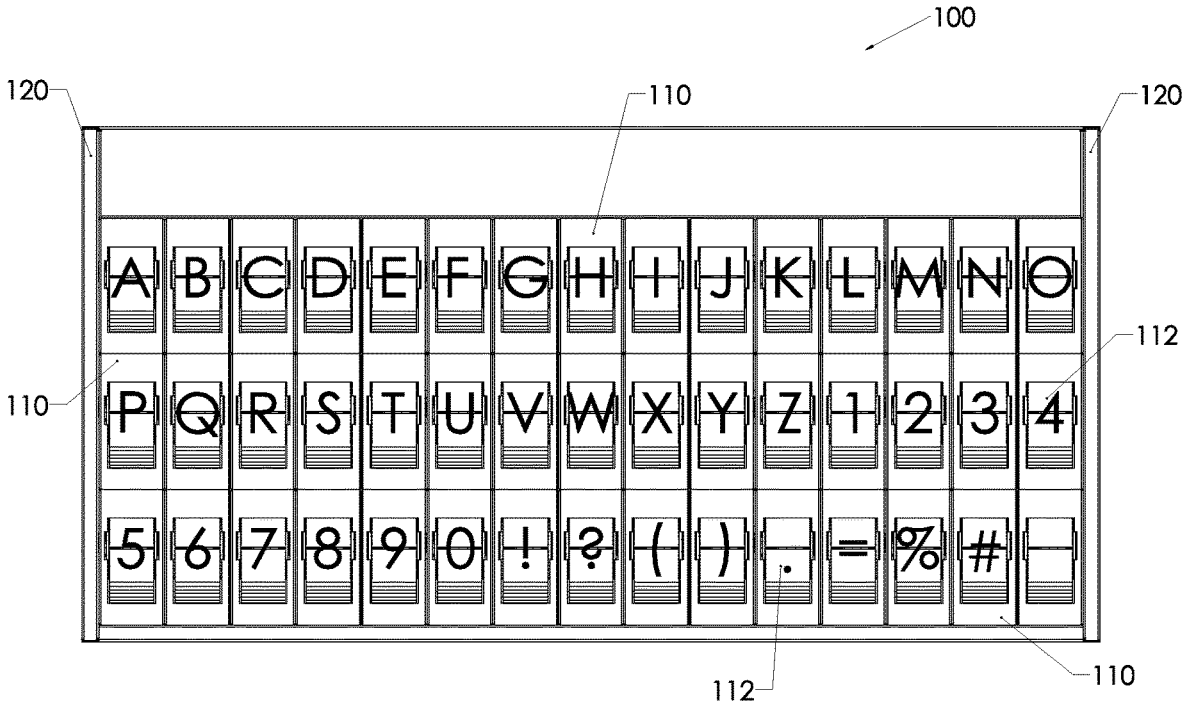
FIG. 1 is a front elevational view of a split flap display according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As shown in the Figures, the present invention is a split flap display 100 ("display" 100) that uses a plurality of independently operated modules 110 that rotate to display a predetermined indicia 112 on one of a plurality of flaps 114 mounted on each module 110. Indicia 112 can be alphanumeric characters, symbols, or other indicia. Modules 110 are typically operated such that, after all modules 110 display their particular indicia, the indicia 112 spell a word or provide some other type of readable message to a viewer.

FIG. 1 shows an exemplary display 100 that has three rows and fifteen columns of modules 110 mounted in an array in a rectangular frame 120. Those skilled in the art, however, will recognize that other sizes of module arrays can be provided.

Figure 2:
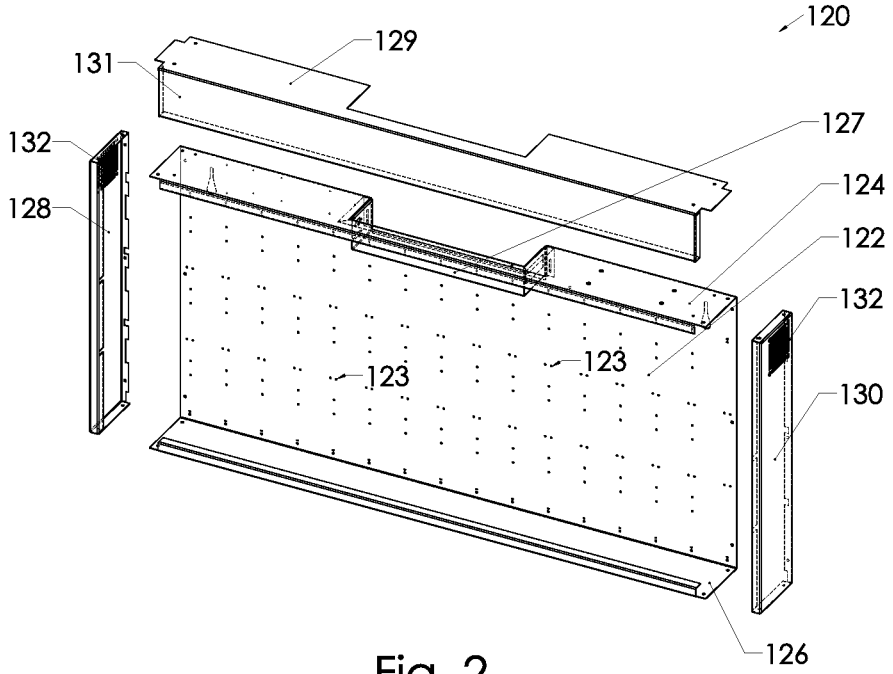
FIG. 2 is an exploded perspective view of a frame for the display shown in FIG. 1.

Referring to FIG. 2, frame 120 has a back panel 122 onto which modules 110 are mounted. Back panel 122 provides a plurality of mounting holes 123 for card guides 140, 142 (shown in FIG. 3) that provide slots for modules 110. Frame 120 can be constructed from sheet metal and can be stamped and bent according to size requirements and the number of modules 110 to be installed in display 100.

Back panel 122 can be integrated with a top surface 124 and a bottom surface 126. Top surface 124 includes a well 127 that receives power input as well as Ethernet and USB hardwired connectors, if required for a particular display 100. A header 129 is removably affixed over top surface 124 to protect any electrical components or connections, as well as to provide a facing 131 that can receive printing or other indicia as desired by the user.

Side panels 128, 130 are removably mounted onto back panel 122. Each side panel 128, 130 includes a mesh screen 132 formed therein to allow for ventilation of display 100. Ventilation fans 134, shown in FIG. 3, are located adjacent each mesh screen 132 and screens 132 are provided with openings sufficiently small to prevent inadvertent insertion of a finger thereinto.

Figure 3:
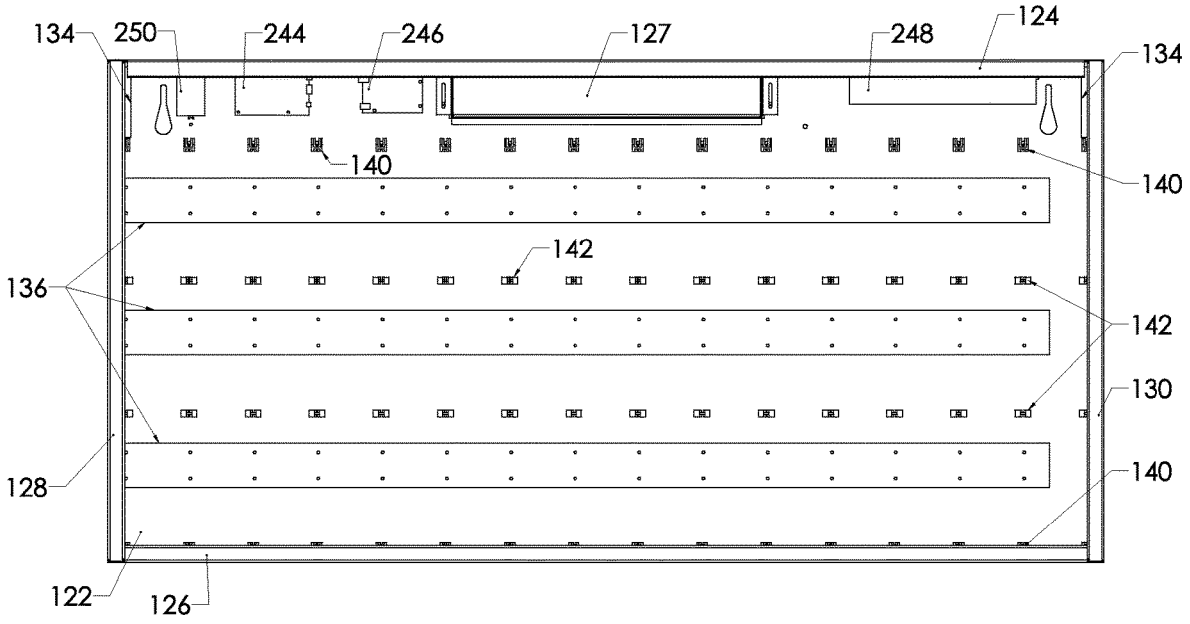
FIG. 3 is a front elevational view of the assembled frame from FIG. 2.

Referring to FIG. 3, rail boards 136 are provided for each row. Rail boards 136 are mounted on back panel 122 and provide electrical connections for each module 110. Additionally, card guides 140, 142 are mounted to back panel 122. Modules 110 are supported by card guides 140, 142. For modules 110 that are to be mounted on a top or bottom row of display 100, card guides 140 are used. For modules 110 that will not be on the top or bottom row (in this example, in the center row), card guides 142 are used.

Card guides 140, 142 can be commercially available guides that are used to mount printed circuit boards. An exemplary provider of such guides is Richco. For circuit boards, a card guide 140, 142 is required for each of the top and the bottom of the board with a single board mounted between two vertically adjacent card guides 140, 142. For display 100, however, two modules 110 are releasably connected to a single card guide 140, while four modules 110 are connected to a single card guide 142. Additionally, two modules 110 can be mounted between two vertically adjacent card guides 140, 142.

Figure 4:
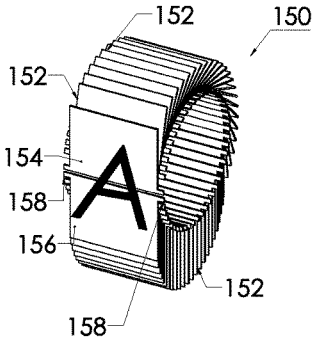
FIG. 4 is a perspective view of a flap carousel used with the display shown in FIG. 1.
Figure 5:
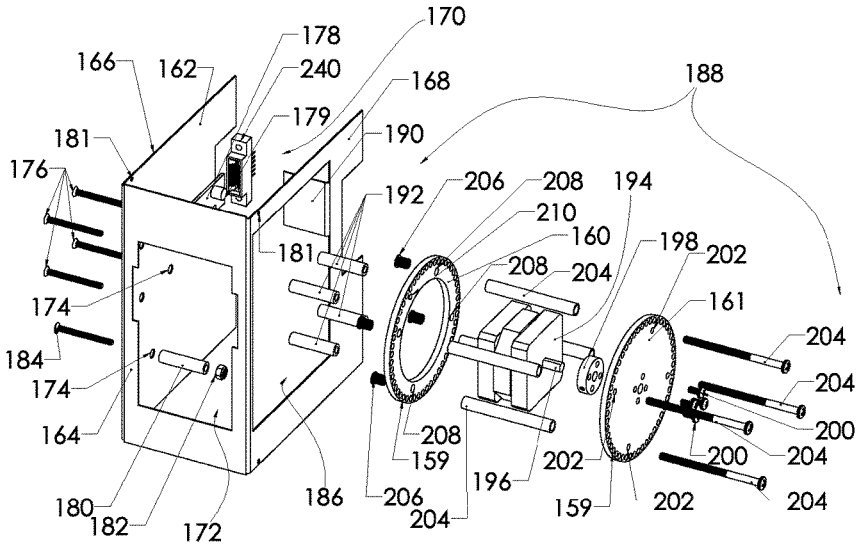
FIG. 5 is an exploded perspective view of a module used with the display shown in FIG. 1.
Figure 6:
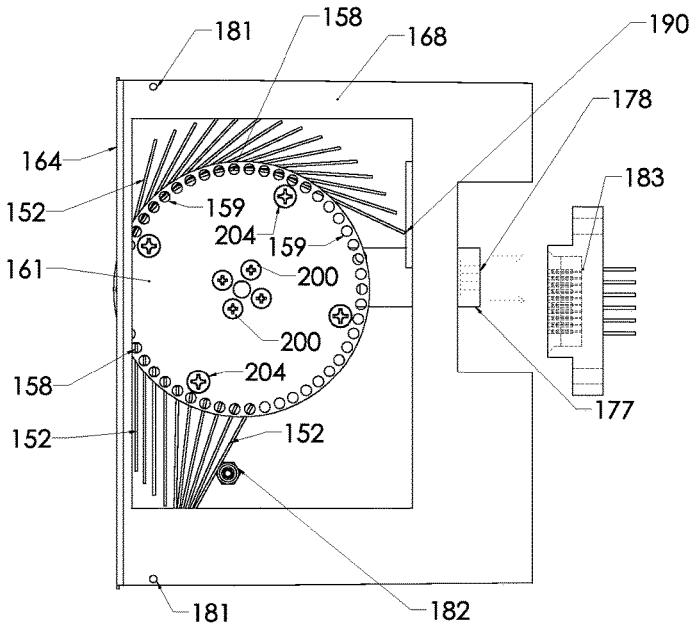
FIG. 6 is a side elevational view of the module shown in FIG. 5, with the flap carousel of FIG. 4 added thereto.

Referring to FIGS. 4-6, modules 110 each includes a carousel 150 comprised of a plurality of flaps 152. In an exemplary embodiment, 50 flaps 152 are provided per carousel 150. Each flap 152 has a front face 154 with the top half of an indicia printed thereon and a rear face 156 with the bottom half of a different indicia printed thereon such that, when the top face 154 of one flap 152 and the bottom face 156 of an adjacent flap 152 are exposed, top face 154 of one flap 152 and bottom face 156 of the adjacent flap 152 form a complete indicia 112, as shown in FIG. 4. Each side of flap 152 includes a side tab 158 extending outwardly therefrom. Side tab 158 engages slot 159 in carousel wheels 160, 161 (shown in FIG. 5), in which flap 152 pivots.

FIG. 5 shows a housing 162 for module 110. Housing 162 is constructed from stamped and bent sheet metal and has a front face 164, left and right sides 166, 168, and an open rear 170. Front face 164 includes an opening 172 that allows flaps 152 to rotate and to be visible.

Left side 166 is generally solid, with openings 174 for motor mounting screws 176 to extend through. A driver board 178 is mounted to an inner face of left side 166. Driver board 178 is used to control operation of module 110, including a Hall Effect sensor 179, as will be discussed in detail below. Driver board 178 includes a male insert 177 that fits into a female card edge module connector 240 that is fixed to signal rail board 136. Card edge module connector 240 receives and transmits signals from the controller to operate module 110.

A sound enhancing rod 180 is secured to left side 166 with a nut 182 and screw 184. As flaps 152 rotate, flaps 152 "slap" sound enhancing rod 180, generating a sound to let people in the vicinity of display 100 hear the operation of display 100. Additionally, sound enhancing rod 180 also serves to prevent the swaying of flaps 152 after turning over during operation of module 110.

Left side 166 also includes top and bottom through holes 181 (only top through hole 181 shown in FIG. 5) for releasable connection to card guides 140, 142.

Right side 168 includes an opening 186 formed therein to allow for connection of a flap 188 rotating assembly therein. An anti-rollback flap 190 is provided on an inner face of right side 168 and is used to make contact with the free end of each flap 152 as flaps 152 rotate during operation and provide a hard stop, preventing carousel 150 from rolling backward.

Right side 168 also includes top and bottom through holes 181 for releasable connection to card guides 140, 142.

A plurality of nylon motor mounts 192 are provided, each motor mount 192 sliding over a retaining screw 176. Motor mounts 192 are arranged in a "square" pattern such that a motor 194 is supported within the square. Motor 194 includes an output shaft 196 that is connected to a motor hub 198. Motor hub 198 is keyed to a right carousel wheel 161 and secured by a plurality of screws 200. Motor 194 is electronically connected to driver board 178 such that driver board 178 operates motor 194.

Right carousel wheel 161 includes plurality of slots 159 spaced therearound to retain one side of each flap 152, as well as through holes 202 sized to allow screws 204 to extend therethrough, as well as through nylon spacers 204 and left carousel wheel 160 for retention by threaded inserts 206 that are press fit through through-openings 208 in left carousel wheel 160.

An inner face of left carousel wheel 160 also includes a magnet 210. Magnet interfaces with the Hall effect sensor 179 on driver board 178 to self-calibrate module 110 each time module 110 rotates such that magnet passes the Hall Effect sensor 179. Magnet 210 provides location information about carousel 150 by generating a signal at the Hall Effect sensor 179 that is transmitted to the controller for display 100.

Figure 7:
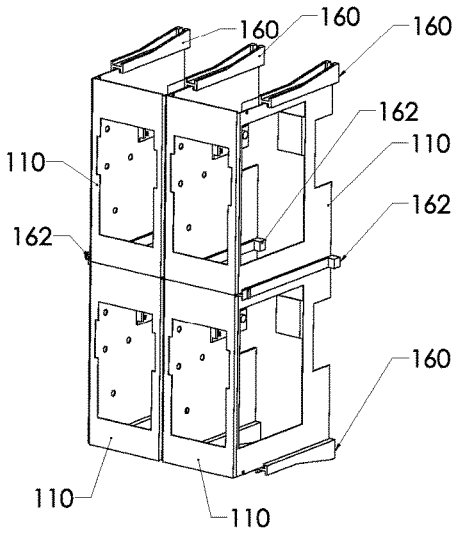
FIG. 7 is a perspective view of a 2×2 array of modules for a split flap display according to another exemplary embodiment of the present invention.
Figure 8:
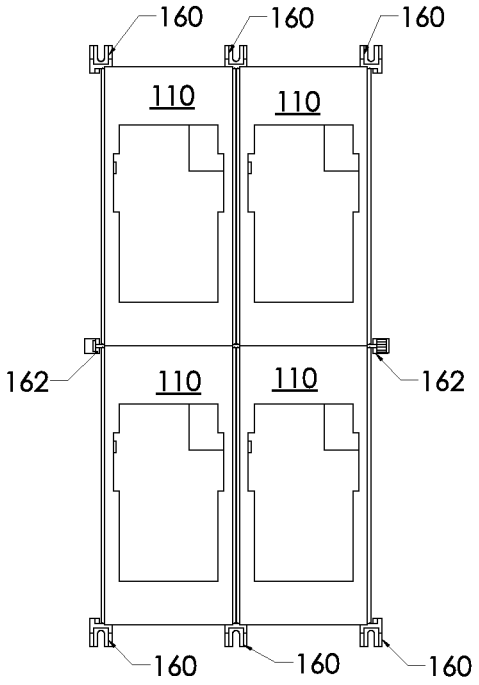
FIG. 8 is a front elevational view of the array shown in FIG. 7.
Figure 9:
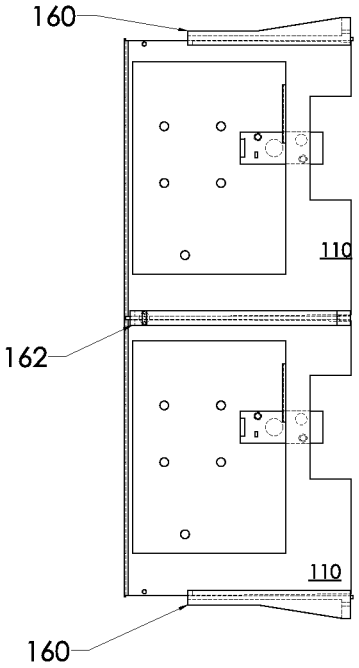
FIG. 9 is a side elevational view of the array shown in FIG. 7.
Figure 10:
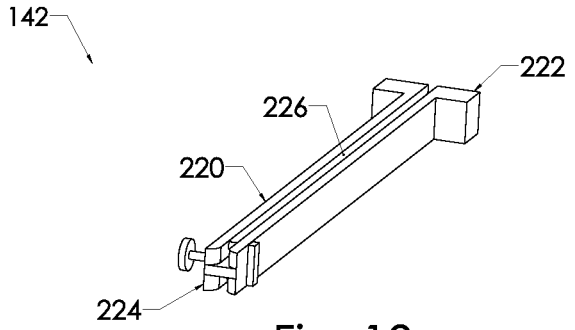
FIG. 10 is a perspective view of a card guide used to releasably secure up to four modules as shown in FIGS. 7-9.

FIGS. 7-9 show an exemplary embodiment of a 2×2 array of modules 110 with card guides 140, 142. A card guide 142 is shown in FIG. 10. Card guide 142 is symmetric about a central horizontal plane. Therefore, only a description of card guide 142 above the plane is provided, with the portion of card guide 142 below the plane being identical.

Figure 11:
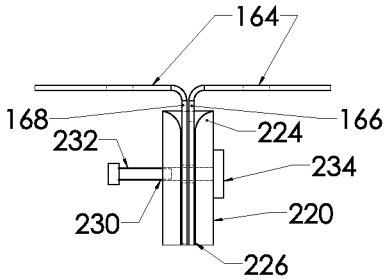
FIG. 11 is a top plan view of the card guide shown in FIG. 10, with two modules inserted therein.
Figure 12:
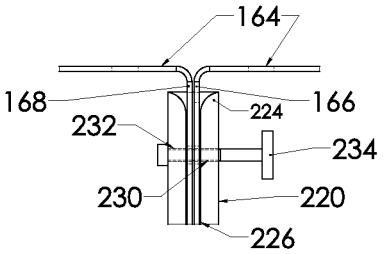
FIG. 12 is a top plan view of the card guide shown in FIG. 11, with two modules releasably locked therein.

Card guide 142 includes an elongate rod 220 having a fixed end 222 that is secured to back panel 122 and a free end 224 into which left and right sides 166, 168 of adjacent modules 110 are inserted. A groove 226 extends the length of rod 220. Groove 226 is wide enough for left and right sides 166, 168 of adjacent modules 110 to fit therein, as shown in FIGS. 11 and 12.

A securing pin 230 includes a locking portion 232 and a release portion 234. Securing pin 230 is slidable between a locking portion (shown in FIG. 12) and an unlocking position (shown in FIG. 11). Locking portion 232 is sized to extend through holes 181 in two adjacent modules 110 to releasably secure the two modules 110 to card guide 142 above the plane. Similarly, a second locking portion 232 is sized to extend through holes 181 in two adjacent modules 110 to releasably secure the two modules 110 to card guide 142 below the plane, such that four modules 110 are retained within card guide 142.

To lock four modules 110 to card guide 142, the four modules 110 are aligned as shown in FIGS. 7-9 and 11, with securing pin 230 in the unlocking position. Securing pin 230 is then pushed to the position shown in FIG. 12. To unlock modules 110, release portion 234 is pushed from the position shown in FIG. 12 to the position shown in FIG. 11.

Figure 13:
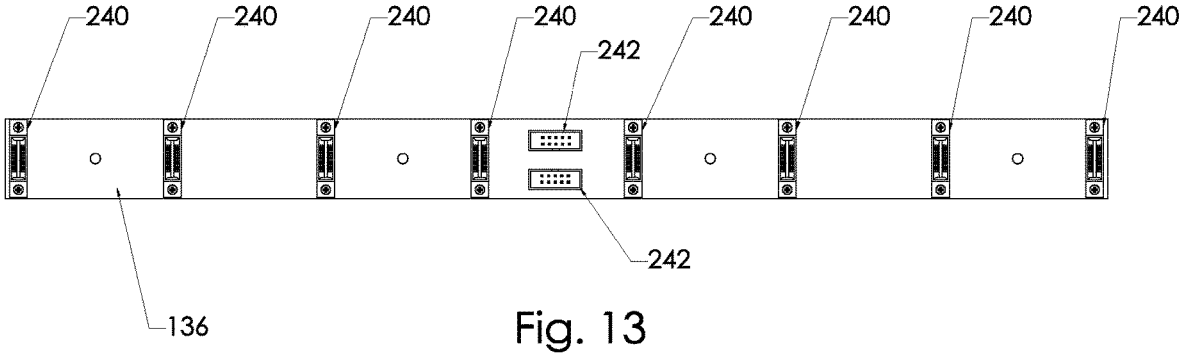
FIG. 13 is a front elevational view of a rail guide used with the display of FIG. 1.
Figure 14:
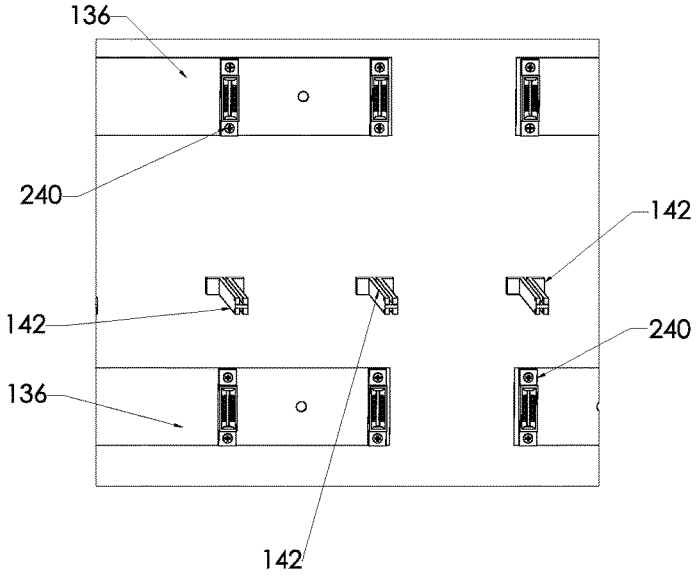
FIG. 14 is a perspective view of a plurality of the rail guides shown in FIG. 13 installed in the display of FIG. 1.

Referring now to FIG. 13, rail board 136 is shown in detail. Rail board 136 is an eight module long controller, although those skilled in the art will recognize that more or less than eight module connectors 240 can be included. An unlimited number of rail boards 136 can be connected together in series, which allows for infinite expandability of display 100. Each module connector 240 accepts a driver board 178 from one of eight modules 110 connected to driver board 136. As shown in FIG. 14, each module connector 240 is located vertically below a corresponding card guide 142 for proper alignment and ease of installation of modules 110 to rail board 136.

Each rail board 136 includes a board controller 242 that is in turn connected to a master controller 244 attached to back panel 122. Rail boards 136 form part of a closed loop control system in which the master controller sends out an electrical signal to operate each motor 194. An exemplary master controller 244 can be an Arduino, which is well known in the art.

When an electrical signal is transmitted to motor 194, motor 194 rotates until the "home" position is detected, the home position is detected when Hall Effect sensor 179 detects magnet 210 and board 136 sends back a 'home' ping to master controller 244. This feature allows for recalibration of module 110 on every rotation.

Optionally, display 100 can be communicated with wirelessly, such as via Rasberry Pi 246 which then transmits a signal to the main controller to operate modules 110. Alternatively, display 100 can be communicated with using a hardwired Ethernet connection (not shown), which transmits to the main controller 244.

To power display 100, each rail board 136 receives a 24 VDC power supply 248 that is electrically connected to board controller 242 for powering motor 194 on each module 110. The data has a 24V-5V converter 250 that distributes electrical power to each board controller 242.

Display 100 has the capability to be set as a "client" (similar to how a web user is a client when using a browser to navigate to a web page) and to set the refresh or call frequency for display 100 to maintain or change the indicia 112 on modules 110 from a specified server/website location. So, if a user wants to integrate display 100 with live data the user points display 100 as a client to that source.

Display 100 can be controlled via a web app that is wireless or wired, with the capability of building out messages containing different screens, playlists containing different messages, and scheduling playlists based on time of day, or other parameters. Also, display 100 allows for instantaneous messaging or changing of indicia 112 on display 100 using what is shown on a PC/mobile/tablet interface that is electronically connected to display 100. Display 100 can be used to display current weather, stock quotes, or other such information. Master controller 244 also allows for changes of time delay between screens in any one message, which can be used to "animate" display 100.

Figure 16:
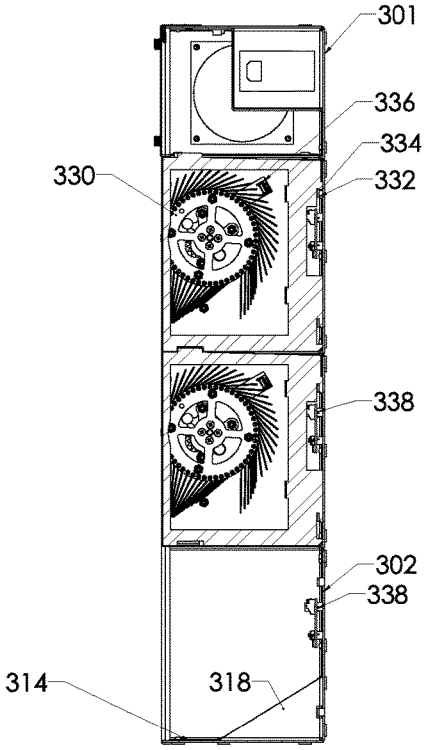
FIG. 16 is a side elevational view, in section, of the split flap display of FIG. 15.
Figure 15:
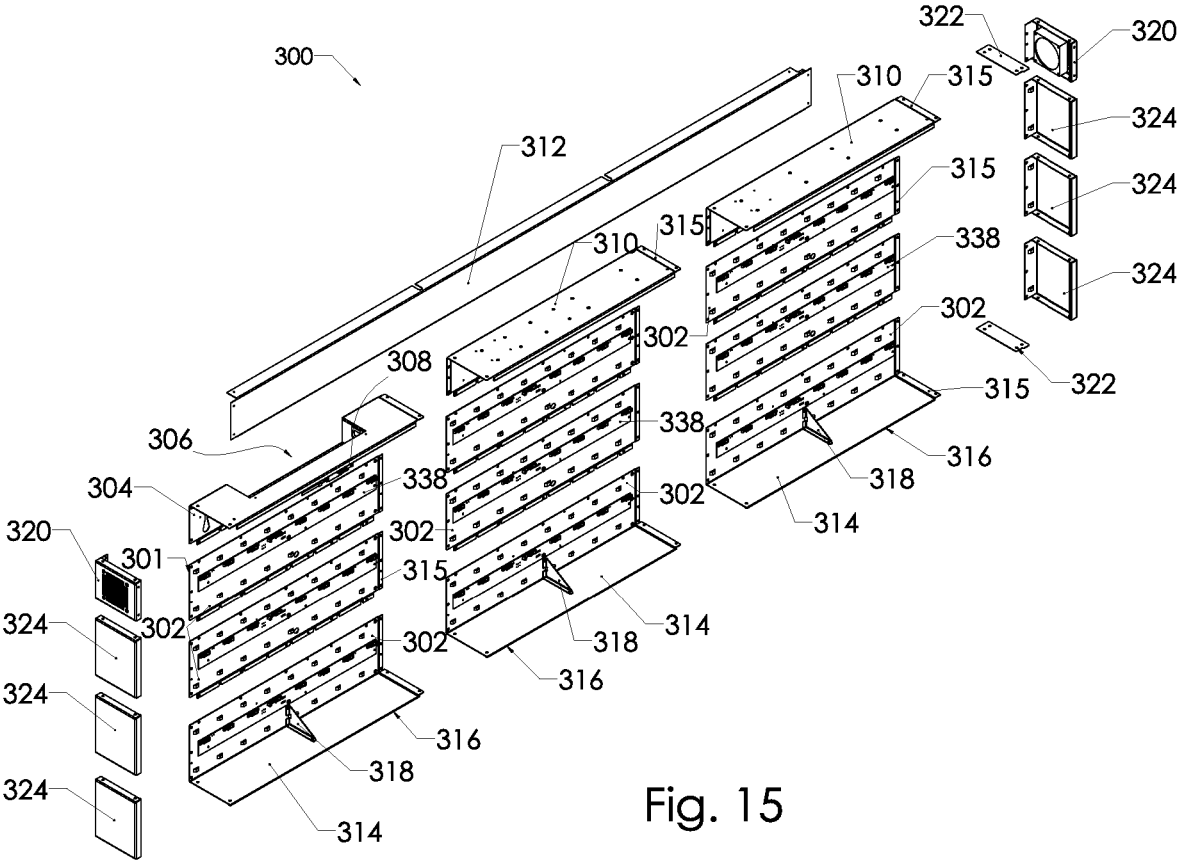
FIG. 15 is an exploded perspective view of a split flap display according to an alternative exemplary embodiment of the invention.
Figure 17:
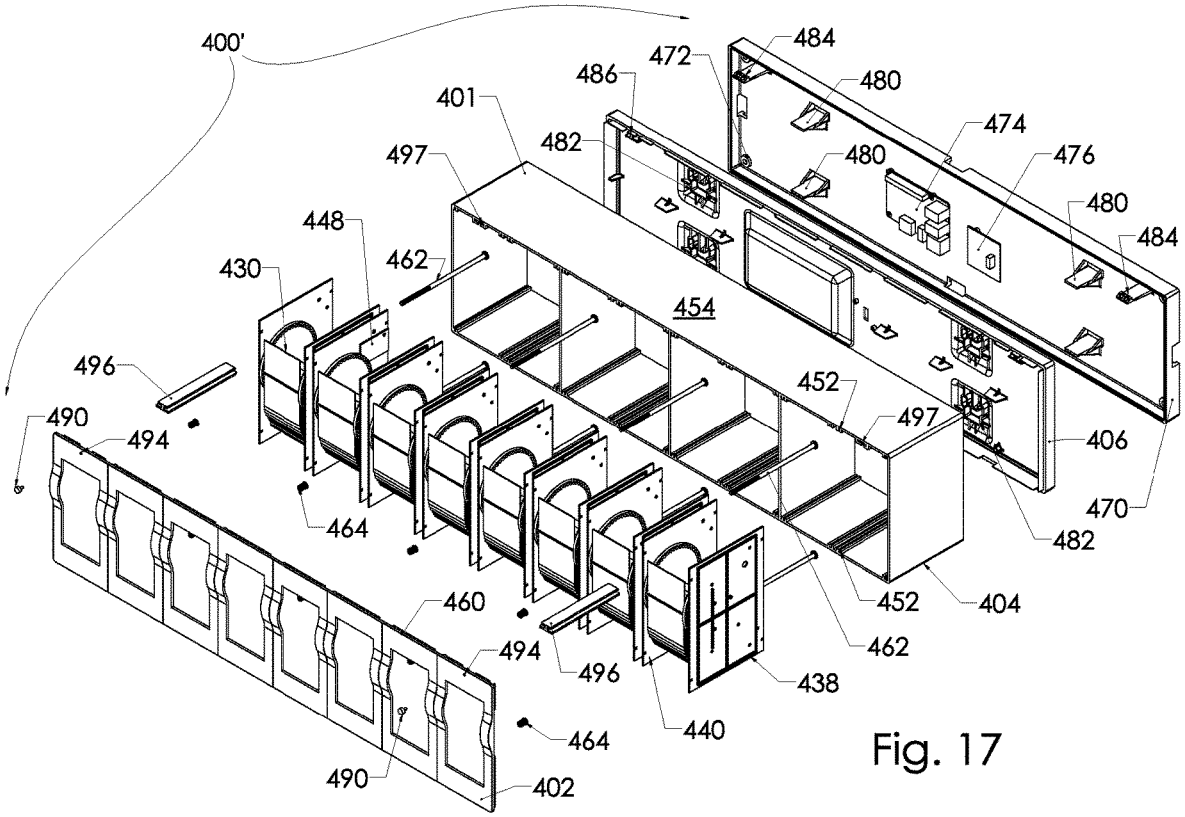
FIG. 17 is an exploded perspective view of a split flap display according to another alternative exemplary embodiment of the invention.

In an alternative embodiment, shown in FIGS. 15-17, a split flap display 300 is shown. Instead of a housing that is custom designed and built based on customer requirements (i.e., a specified number of rows and a specified number of columns), Display 300 is modular, with prefabricated housing backplates 302 that are a single row and eight (8) columns wide. Multiple housing backplates 302 can be connected together to provide a display 300 of any size, with the number of columns being a whole number multiple of the number of columns in the housing 302. As shown in FIG. 15, display 300 is an exemplary three rows with three back plates 302 (24 columns). While eight (8) columns are used, those skilled in the art will recognize that more or less than eight (8) columns can be used.

Display 300 includes a cabinet 301 constructed from a master header 304 that is located in the top left corner of a multi-backplate assembly 300. Master header 304 is a generally inverted "L-shaped" panel constructed from sheet metal. Power and data enter display 300 through a cutout 306 in master header 304 and connect to a controller 308 mounted on master header 304.

If display is more than eight columns wide, repeat headers 310 are added in series next to master header 304 to pattern out the desired number of columns in display 300. Similar to master header 304, repeat headers 310 are generally inverted "L-shaped" panels constructed from sheet metal. As shown in FIG. 15, two repeat headers 310 are provided, although those skilled in the art will recognize that more or less than two repeat headers 310 can be used.

The repeat headers 310 form a header row, which serves to house extra power supplies and other electronics (not shown) necessary for larger signs. Master header 304 and repeat headers 310 are covered by a removable header panel 312, which is easily removed via thumbscrews (not shown)

in the top of display 300. Header panel 312 is custom built, depending on the number of columns for display 300.

Bottom panels 314 provide a back plate 302, along with a bottom plate 316. A gusset 318 located about half way between the end of bottom plate 316 and is attached to its respective back plate 302 to provide support. If display 300 is only a single row display, then bottom panel 314 is used and is connected directly to master header 304 or a repeat header 310.

Header side panels 320 are provided to cap the ends of the headers 304, 306, and spacer plates 322 are provided at the top and bottom of the rightmost part of display 300. Header side panels 320 are vented to provide for air circulation to cool controller 308.

All back plates 302, headers 304, 310, and bottom panels 314 have jog bends 315 that lap over the pieces to the right and below them. Where the lapping of sheet metal between adjacent back plates 302, headers 304, 310, and bottom panels 314 occurs, connectors, such as screws or rivets, are installed via concentric holes in both pieces. In this way, these panels pattern out in width and height in standard dimensions to construct cabinet 301. Side walls 324 are also modular, and are secured together to make up the height of the sides of display 300. Side walls 324 are then secured to the left and right most back plates 302 and bottom panels 314 to complete cabinet 301.

Referring to FIG. 16, split flap modules 330 are locked into the back plates 302 (if used) and bottom panels 314 via lance features 332 punched into the back of the sheet metal panels forming back plates 302 and bottom panels 314. Lance features 332 accept a hook 334 in the back of each module 330, dropping down into place and resting on each hook 334. Each module 330 includes a cable (not shown) that releasably connects a module board 336 in each module 330 to a shifter rail 338 mounted on each back plate 302 and bottom panel 314. Each lance feature 332 holds hook 334 of each of two adjacent modules 330, allowing the array of modules 330 to hang securely within cabinet 301.

In the event of a malfunctioning module 330, to remove that module 330 from cabinet 301 header panel 312 is first removed from cabinet 301. Removing header panel 312 provides necessary clearance above the top row of modules 330 to lift hooks 334 up and out of lances 332. To remove a module 330 from a row other than the top row, the modules 330 above the desired module 330 are first raised up in this manner, allowing vertical space for the desired module 330 to be lifted out of its respective hooks 334 and removed from cabinet 301. A replacement module 330 can be re-inserted into cabinet 301 by raising any modules 330 above the area where the replacement module 330 is to be inserted, inserting the new module 330, lowering the modules 330 above the new module 330, and replacing header panel 312.

Figure 18:
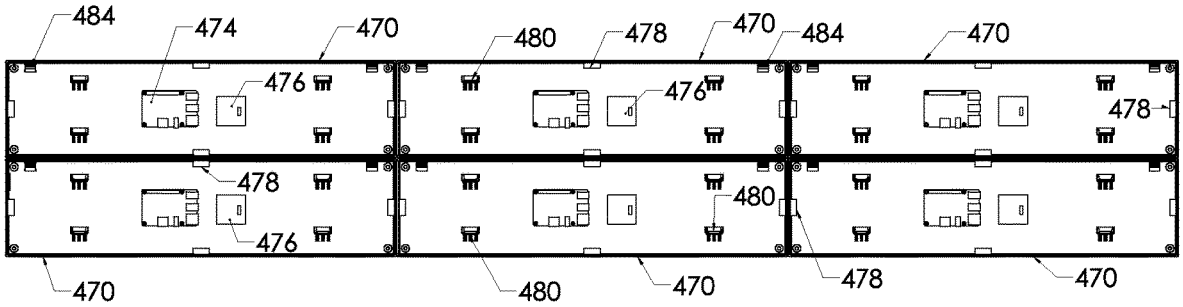
FIG. 18 is a front elevational view of a plurality of back panels of the display of FIG. 17, aligned in an array.
Figure 19:
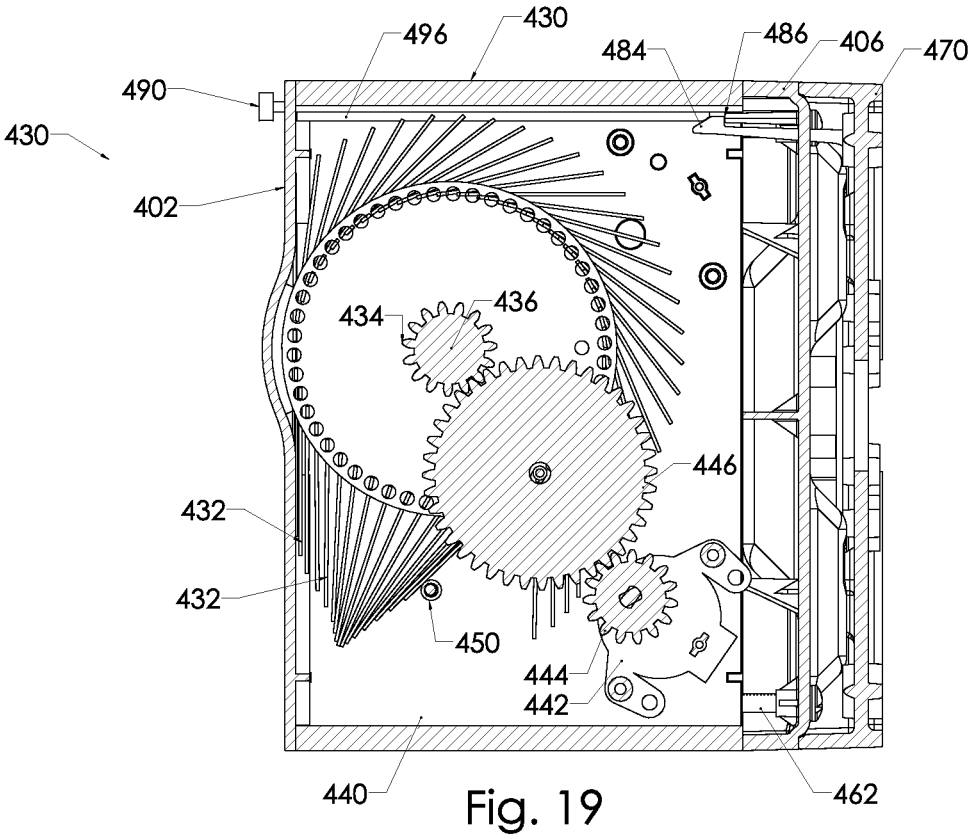
FIG. 19 is a side elevational view of a module of the display of FIG. 17.

In an alternative embodiment, shown in FIGS. 17-19, a split flap display assembly 400 includes at least one stand-alone wall mounted display 400' having a single row of eight (8) modules 430 of split flap characters. Assembly 400 can accept additional displays 400', either horizontally (to add columns), vertically (to add rows), or both (to add columns and rows) to expand the network and size of assembly 400. The additional displays 400' can be added when the first display 400' is mounted or, alternatively, displays 400' can be added later on to expand display 400, allowing for a modular and retroactive expansion of display 400.

Each display 400' includes a cabinet 401 having a front face 402, an extruded parallelepiped body 404 and a back panel 406, which provide a fully enclosed cabinet 401. Modules 430 are removably inserted into cabinet 401. Referring to FIG. 20, in an exemplary embodiment, each module 430 includes a plurality of flaps 432 on a carousel 434 that rotates on an axis 436. In an exemplary embodiment, fifty (50) flaps 432 are provided, although those skilled in the art will recognize that more or less than fifty (50) flaps 432 can be provided. Each flap 432 includes indicia provided thereon such that, when carousel 434 is stopped from rotating, adjacent flaps display a letter, a number, or some other character to be read on display 400'.

Two side walls 438, 440 (shown in FIG. 17) provide rotation points for carousel 434, as well as mounts for a drive motor 442 and drive shaft gear 444, mounts for a drive train-gear 446, mounting locations for an electronic board 448 (shown in FIG. 17), which provides motor commands and records positional information of carousel 434 via a Hall Effect sensor, such as Hall Effect sensor 179 discussed above, and mounting locations for a sound enhancing rod 450. Sound enhancing rod 450 provides both a stop for falling flaps 432 as carousel 434 rotates, which improves visibility of characters on flaps 434 by halting the falling motion, and amplifies the sound of the falling flaps 434. The two side walls 438, 440 and their components are identical, completely reversible parts.

Body 404 has ridges 452 on internal top and bottom faces 454, 456, respectively, which allows each side wall 438, 440 of each module 430 to slide into, providing equal spacing and rigidity for each module 430. Front face 402 and back panel 406 are each guided into body 404 by molded internal lips 460. Once the front face 402, the body 404, and back panel 406 are in place, screws 462 are slid in through the rear of back panel 406 and threaded into inserts 464 that are friction fit into the inside of front face 402.

Each display 400' is attached to a respective wall panel 470 via wall panel guides 480 that slide through support cutouts 482 in back panel 406, allowing the full weight of the display 400' to rest on the guides 480. Cantilevered snap locks 484 extend from wall panel 470, extend through openings in back panel 406, and engage a locking slot 486 inside display 400'.

To install a display 400', a user first mounts wall panel 470 in a desired location using screws (not shown) inserted through mount holes 472 in wall panel 470. FIG. 18 shows an example of six (6) wall panels 470 mounted in a grid. A master controller 474, such as a Raspberry Pi, which is only provided for the first display 400' in the grid (and not for the remaining displays 400'), provides a receiver for receiving electronic signals and commands over Wifi. Breakout boards 476 are also housed in each wall mount panel 470; these boards pass along signals from master controller 474 to its respective display 400' and to the modules 430 in each display 400'. Each breakout board 476, is connected to adjacent unit breakout boards 476 via ribbon cables (not shown) in each cardinal direction via cutouts 478 in each wall panel 470. A network of displays 400' can be built and linked via breakout boards 476 as large as the user desires.

With the network of wall mount panels installed in the desired grid and locations, wall panel guides 480 are slid through support cutouts 482 in the back panel of back panel 406. Snap locks 484 engage locking slot 486 inside display 400'. Locking in this manner allows users to easily mount displays 400' with a simple push toward the wall, and does not allow display 400' to be accidentally dislodged or unlocked.

In order to unlock and remove a display 400' from the wall panel 470 in the event of a failure of one or more carousels 434 in a display 400', display 400' can be removed from the wall without affecting any remaining displays 400' on the wall.

To remove display 400', two keys 490 are provided, one on either side of display 400', proximate to the top of display 400'. Key 490 is used to unlock display 400' from wall panel 470 by inserting the male end of the key 490 into a small opening 494 at the top of the left and rightmost side of display 400'. Once inserted, the user pushes both keys 490 into openings 494 and toward the wall to apply pressure to slide locks 496 that are located directly behind each respective opening 494. The slide locks 496 are allowed only 1 degree of freedom by longitudinally sliding along internal channels 497 along the bottom face of 454 of body 404. This displacement of the slide locks 496 toward the back of display 400' applies pressure on snap locks 484, biasing snap locks 484 downward and out of locking slot 486, thereby allowing display 400' to slide off the wall mount panel guides 480.

In an exemplary embodiment, modules 430 can be the same as modules 330 described above. Operation of modules 330, 430 can be the same or similar to the operation of modules 110 described above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A split flap display comprising:
- a wall frame mounted on a wall, wherein the wall frame comprises:
  - a plurality of panel guides extending outwardly therefrom;
  - a breakout board mounted thereon; and
  - a plurality of cantilevered snap locks extending outwardly therefrom; and
- a first array of carousel modules mounted in a cabinet, the first array being comprised of a single row and a plurality of columns, the cabinet comprising:
- a locking slot adapted to relesably receive a free end of one of the plurality of cantilevered snap locks; and
- a slide lock configured for longitudinal translation engagement with the free end of one of the plurality of cantilevered snap locks, such that translation of the slide lock displaces the free end of the cantilevered snap lock out of engagement with the locking slot such that, when the free end of the cantilevered snap lock is out of engagement with the locking slot, the array can be removed from the wall frame.

2. The split flap display according to claim 1, wherein a plurality of additional arrays are configured for mounting adjacent to the array, and wherein each array comprises a cutout in each cardinal direction such that electronic cables can pass through adjacent cutouts and provide electronic communication between adjacent arrays.

3. The split flap display according to claim 1, wherein each carousel module comprises a rotating carousel, each carousel containing a plurality of flaps mounted thereon such that, as the carousel rotates, adjacent flaps display a character.

4. The split flap display according to claim 3, further comprising a sound enhancing rod configured to engage the plurality of flaps and both stop the flaps and generate a sound from the flaps striking the sounding enhancing rod.

5. The split flap display according to claim 1, further comprising a key extending exteriorly of the array, wherein the key is adapted to engage the slide lock and longitudinally translate the slide lock.

6. The split flap display according to claim 1, further comprising a master controller mounted on the wall frame.

7. The split flap display according to claim 6, further comprising a plurality of additional arrays configured to electronically connect to the first array, wherein the additional arrays do not include a master controller.

8. The split flap display according to claim 7, wherein each of the plurality of additional arrays includes the breakout board, wherein the master controller is electronically connected to each of the breakout boards.

9. A split flap display comprising:
- a cabinet; and
- a plurality of modules located in the cabinet in a first array, each of the plurality of modules comprising a plurality of motor driven carousels, wherein each of the carousels includes a plurality of flaps,
- wherein the first array comprises a single row and a plurality of columns; and
- wherein the cabinet comprises a first back panel, wherein each of the modules is electronically connected to the first back panel.

10. The split flap display according to claim 9, further comprising a master controller mounted on the first back panel.

11. The split flap display according to claim 10, further comprising at least one additional array electronically connected to the first array.

12. The split flap display according to claim 11, wherein the at least one additional array does not include a master controller.

13. The split flap display according to claim 9, wherein each of the plurality of flaps has a front face with a top half of an indicia printed thereon and a rear face with a bottom half of a different indicia printed thereon.

* * * * *